US009463474B2

(12) United States Patent
Yoshida et al.

(10) Patent No.: US 9,463,474 B2
(45) Date of Patent: Oct. 11, 2016

(54) CENTRIFUGAL SEPARATOR EQUIPPED WITH SEPARATED LIQUID JETTING DEVICE INCLUDING JET NOZZLE AND RELEASE PORT

(71) Applicant: TOMOE ENGINEERING CO., LTD., Shinagawa-ku, Tokyo (JP)

(72) Inventors: Takao Yoshida, Mito (JP); Masaru Nagasu, Yokohama (JP)

(73) Assignee: TOMOE ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 14/377,489

(22) PCT Filed: Oct. 11, 2013

(86) PCT No.: PCT/JP2013/006110

§ 371 (c)(1),
(2) Date: Aug. 7, 2014

(87) PCT Pub. No.: WO2014/068872

PCT Pub. Date: May 8, 2014

(65) Prior Publication Data

US 2015/0011372 A1 Jan. 8, 2015

(30) Foreign Application Priority Data

Nov. 2, 2012 (JP) ..... 2012-242548

(51) Int. Cl.
*B04B 1/20* (2006.01)
*B04B 11/02* (2006.01)

(52) U.S. Cl.
CPC ..... *B04B 11/02* (2013.01); *B04B 1/20* (2013.01); *B04B 2001/2075* (2013.01); *B04B 2001/2083* (2013.01)

(58) Field of Classification Search
CPC ..... B04B 1/20; B04B 11/00; B04B 11/02; B04B 2001/2083; B04B 2001/2075
USPC ..... 494/53, 54, 56, 57; 210/380.1, 380.3
See application file for complete search history.

(56) References Cited

U.S. PATENT DOCUMENTS 4,334,647 A 6/1982 Taylor
7,022,061 B2 * 4/2006 Leung ..... B04B 1/20 494/56

(Continued)

FOREIGN PATENT DOCUMENTS

DE 3904151 A1 8/1990
JP 57197055 A 12/1982

(Continued)

OTHER PUBLICATIONS

Japanese Office Action dated Jan. 22, 2013, issued in counterpart Japanese Application No. 2012-242548.

(Continued)

*Primary Examiner* — Charles Cooley
(74) *Attorney, Agent, or Firm* — Holtz, Holtz & Volek PC

(57) ABSTRACT

A centrifugal separator separates liquid from solid and includes a hollow bowl and a screw conveyor, the solid discharged from one end of the bowl and the liquid discharged from plural liquid discharge ports at an opposite end of the bowl, the separator further includes a separated liquid jetting device which collects separated liquid that has overflowed the top of an overflow edge of a dam disposed on each discharge port. The separated liquid jetting device has a separated liquid retention chamber that temporarily retains the collected separated liquid inside thereof, a jet nozzle that is open in the direction opposite to the rotation direction of the bowl and that jets out the liquid located inside the separated liquid retention chamber to the outside and the separated liquid jetting device also has a release port formed above the jet nozzle.

4 Claims, 6 Drawing Sheets

(56) References Cited

U.S. PATENT DOCUMENTS

| | | | | |
|---|---|---|---|---|
| 7,326,169 | B2 * | 2/2008 | Bruning | B04B 1/20 494/53 |
| 9,126,208 | B2 * | 9/2015 | Madsen | B04B 1/20 |
| 9,333,514 | B2 * | 5/2016 | Terholsen | B04B 1/20 |
| 2001/0011056 | A1 | 8/2001 | Pieralisi | |
| 2004/0072667 | A1 * | 4/2004 | Leung | B04B 1/20 494/56 |
| 2004/0072668 | A1 * | 4/2004 | Leung | B04B 1/20 494/56 |
| 2015/0273482 | A1 * | 10/2015 | Bauer | B04B 1/20 494/43 |
| 2015/0360240 | A1 * | 12/2015 | Vielhuber | B04B 1/20 |
| 2016/0067718 | A1 * | 3/2016 | Schlarb | B04B 1/20 |

FOREIGN PATENT DOCUMENTS

| | | | | | |
|---|---|---|---|---|---|
| JP | 11179236 | A | | 7/1999 | |
| JP | 11197547 | A | * | 7/1999 | |
| JP | 11197548 | A | * | 7/1999 | |
| JP | 2010525945 | A | | 7/2010 | |
| WO | WO 2004035220 | A1 | * | 4/2004 | B04B 1/20 |

OTHER PUBLICATIONS

International Search Report (ISR) dated Feb. 1, 2014 issued in International Application No. PCT/JP2013/006110.

Written Opinion of the International Searching Authority (in English) dated Feb. 1, 2014, issued in parent International Application No. PCT/JP2013/006110.

* cited by examiner

CENTRIFUGAL SEPARATOR EQUIPPED WITH SEPARATED LIQUID JETTING DEVICE INCLUDING JET NOZZLE AND RELEASE PORT

TECHNICAL FIELD

The present invention relates to a decanter-type centrifugal separator that separates raw liquid to be processed into a liquid and a solid content, and more particularly to a decanter-type centrifugal separator equipped with a separated liquid jet nozzle capable of generating an auxiliary force for rotationally driving a bowl.

BACKGROUND ART

As shown in FIG. 8, a decanter-type centrifugal separator 1 used for solid-liquid separation has a hollow bowl 2 and a screw conveyor 3 disposed coaxially with the bowl 2 inside thereof. The separator 1 is configured such that where the bowl 2 and the screw conveyor 3 are rotated at a high speed, the raw liquid to be processed introduced into the bowl 2 through a feed tube 4 is separated by a centrifugal force into a liquid (liquid phase) and a solid content (solid phase), and the two phases are individually discharged into a liquid recovery system and a solid recovery system.

More specifically, where the raw liquid to be processed is introduced into the bowl 2 rotated at a high speed, the solid content, which has a high density, precipitates to a position close to the inner circumferential surface of the bowl 2 under the effect of the centrifugal force, the liquid, which has a low density, is positioned on radially inward of the precipitated solid content, and a state is assumed in which the solid phase on the outer side is separated from the liquid phase on the inner side. The precipitated solid content is transported by the screw conveyor 3 rotating with a predetermined difference in speed with respect to the bowl 2 toward a solid discharge port 5 formed at one end of the bowl 2 (left end in FIG. 8), and the solid content is discharged from the discharge port 5 to the outside of the bowl 2 (to the solid recovery system). Meanwhile, the separated liquid is discharged from a liquid discharge port 6 formed at the opposite end of the bowl 2 (right end in FIG. 8) to the outside of the bowl 2 (to the liquid recovery system). A dam 7 determining the level of liquid is disposed in the liquid discharge port 6, and the separated liquid is discharged by overflowing the top (on radially inward) of the overflow edge of the dam 7.

In the decanter-type centrifugal separator 1 of this type, very large drive energy (electric power) is necessary to rotate the bowl 2 and the screw conveyor 3 at a high speed. Therefore, a variety of measures have been used to reduce energy consumption.

For example, US 2004/0072667 A1 and US 2004/0072668 A1 disclose a centrifugal separator configured such that a hole passing through a bowl is formed in a dam or in the vicinity thereof, a jet nozzle is attached so as to protrude from the through hole to the outside of the bowl and so as to be open in the direction opposite to the rotation direction of the bowl, and the separated liquid in the bowl not only overflows from above the overflow edge of the dam, but is also discharged from the jet nozzle. In such a centrifugal separator, a counterforce generated when the separated liquid in the bowl is jetted out from the jet nozzle can be used as an auxiliary force for rotationally driving the bowl. As a result, energy consumption for rotationally driving the bowl can be reduced.

Further, JP 2010-525945 A discloses a centrifugal separator configured such that a casing (33) forming a discharge opening (36) which is open in the direction opposite to the rotation direction of the bowl is attached to a liquid discharge port, instead of attaching a dam to the liquid discharge port, and the separated liquid overflowing the top of an overflow edge (39) of a dam plate (45) disposed in the discharge opening (36) is discharged in the direction opposite to the rotation direction of the bowl. In such centrifugal separator, the energy of the rotating separated liquid can be obtained again in the discharge opening. As a result, when the separated liquid is discharged in the direction opposite to the rotation direction, power within a range of 10 to 15% can be obtained.

CITATION LIST

Patent Literature

PTL 1: US 2004/0072667 A1
PTL 2: US 2004/0072668 A1
PTL 3: JP 2010-525945 A

SUMMARY OF INVENTION

Technical Problem

However, a problem associated with the decanter-type centrifugal separator, such as described in Patent Documents 1 and 2, is that although energy consumption on the rotation drive of the bowl can be reduced, the solid contained in the raw liquid to be processed is discharged through the jet nozzle into the liquid recovery system. Another problem is that when the treatment conditions are changed, an adverse effect is produced on the water content ratio in the solid discharged from the solid discharge port.

In particular, where solid-liquid separation of a raw liquid is to be continuously implemented using a decanter-type centrifugal separator, that is, when the raw liquid is to be continuously introduced into the bowl and the separated liquid and the solid content are to be continuously discharged, the solid content is found at a certain ratio in the separated liquid 20 inside the bowl 2, as shown by gradation in FIG. 9. The concentration of the solid content is the lowest in the vicinity of the liquid level (position of a double-dot-dash line L), but increases gradually with the distance from the liquid level (as the distance from the liquid level is increased and the interface 22 with the solid phase 21 is approached).

In the centrifugal separator such as described in Patent Documents 1 and 2, a through hole 23*a* (or a through hole 23*b*) causing the separated liquid 20 to flow downward from the bowl 2 to the jet nozzle is formed on radially outward of an overflow edge 7*a* of the dam 7, which determines the liquid level of the separated liquid 20 inside the bowl 2. Therefore, the separated liquid 20 positioned on radially outward of the liquid level, that is, the separated liquid 20 with a solid content concentration higher than that of the separated liquid close to the liquid level is discharged through the through hole 23*a* (or the through hole 23*b*) to the outside of the bowl 2. As a result, the solid contained in the raw liquid is discharged to the liquid recovery system.

Further, where a structure is used in which the separated liquid 20 in the bowl 2 is discharged from the through hole 23*a* (or the through hole 23*b*) formed on radially outward of the overflow edge 7*a* of the dam 7, when the centrifugal force or treatment amount that have been initially set are changed, there is a possibility that the liquid level L in the bowl 2 decreases, and the value of water content ratio in the solid content discharged from the solid discharge port 5 deviates from the target range.

Meanwhile, in the centrifugal separator described in Patent Document 3, the discharge opening (36) for discharging the separated liquid has a large opening area, that is, the discharge opening (36) extends radially inward to the position above the maximum level of the separated liquid inside the bowl, and the separator is not configured such that the separated liquid is jetted out. Therefore, a sufficient rotational auxiliary force cannot be expected.

In the Patent Document 3, an orifice (37) making it possible to jet out the separated liquid is formed in the dam plate (45), but this orifice (37) is formed on radially outward of the overflow edge (39) of the dam plate (45). As a result, the solid contained in the raw liquid is discharged to the liquid recovery system and that an adverse effect is produced on the water content ratio in the discharged solid content, in the same manner as in Patent Documents 1 and 2.

The present invention has been created to resolve the above-described problems inherent to the conventional arts, and it is an object of the present invention to provide a centrifugal separator equipped with a separated liquid jet nozzle in which energy consumption on the rotational drive of the bowl can be reduced, the problem of the solid contained in the raw liquid being discharged through the jet nozzle to the liquid recovery system can be avoided, and the problem of the adverse effect being produced on the water content ratio in the discharged solid content when the treatment conditions are changed can be also avoided.

Solution to Problem

A centrifugal separator in accordance with the present invention includes a hollow bowl, and a screw conveyor which is disposed coaxially with the hollow bowl inside the hollow bowl, and the centrifugal separator is adapted to process a raw liquid introduced in the hollow bowl such that the raw liquid is separated by a centrifugal force into a liquid and a solid content as a result of rotation of the hollow bowl and the screw conveyor, the separated solid content is transported by the screw conveyor rotating with a difference in speed with respect to the hollow bowl to a solid discharge port formed at one end of the hollow bowl, and the solid content is discharged to the outside of the hollow bowl, and the separated liquid is discharged to the outside of the bowl from a plurality of liquid discharge ports formed in a front hub constituting an opposite end of the hollow bowl, wherein a dam determining a liquid level inside the bowl is disposed in each of the plurality of liquid discharge ports; the centrifugal separator further includes a separated liquid jetting device which collects the separated liquid that has overflowed a top of an overflow edge of a corresponding dam and that has been discharged from the hollow bowl, wherein the separated liquid jetting device is attached to the front hub at a position radially outward of each of the plurality of liquid discharge ports; wherein each separated liquid jetting device includes a separated liquid tank that is container-shaped, that has side sections and a bottom section which are water-tightly connected to each other and to the front hub, and that is positioned such that a front hub area radially outward of a corresponding liquid discharge port is surrounded by the side sections and the bottom section of the separated liquid tank so as to define a space of the separated liquid tank where the separated liquid is pooled, and wherein each separated liquid letting device further includes a separated liquid jet nozzle that is open in a direction opposite to the rotation direction of the hollow bowl, that jets out the separated liquid located inside the separated liquid tank to the outside, and that is disposed at any of the side sections or the bottom section of the separated liquid tank.

It is preferred that a release port that releases an excess of the separated liquid retained in the separated liquid retention chamber be formed in the separated liquid jetting device at a position on radially inward of the jet nozzle, and it is also preferred that the release port be configured such that a lower edge thereof is positioned on radially outward of the overflow edge of the dam. Further, it is preferred that the jet nozzle be disposed at a position on radially outward of a position distant from the overflow edge of the dam by 50% of the distance from the overflow edge of the dam to an outer circumference of the front hub.

Advantageous Effects of Invention

In the centrifugal separator equipped with a separated liquid jet nozzle in accordance with the present invention, the separated liquid that overflows the top of the overflow edge of the dam and is continuously discharged from the liquid discharge ports to the outside of the bowl is collected by the separated liquid jetting devices, which are disposed on radially outward of the liquid discharge ports, and is jetted out in the direction opposite to the rotation direction of the bowl from the jet nozzles open the direction opposite to the rotation direction of the bowl, and the counterforce generated by jetting out the separated liquid can be used as an auxiliary force for rotationally driving the bowl. As a result, energy consumption of the rotational drive of the bowl can be reduced. Further, since the separator is configured such that the separated liquid with a very low concentration of the solid content is discharged from the jet nozzles, a problem of the solid contained in the raw liquid being discharged to the liquid recovery system can be advantageously avoided.

Further, since the centrifugal separator equipped with a separated liquid jet nozzle in accordance with the present invention is configured such that the separated liquid flowing out from the bowl over the overflow edge of the dam is collected and jetted out, the decrease in the liquid level inside the bowl can be prevented even when the treatment conditions are changed. Therefore, the problem of the value of water content ratio in the solid content discharged from the solid discharge port deviates from the target range can be advantageously prevented.

Further, when the release port for the separated liquid is formed in the separated liquid jetting device at a position on radially inward of the jet nozzle, and the lower edge of the release port is positioned on radially outward of the overflow edge of the dam, even when the liquid level of the separated liquid retained inside the separated liquid retention chamber rises, the excess can be released to the outside of the device, and the liquid level of the separated liquid inside the separated liquid retention chamber can be restricted to the position on radially outward of the overflow edge of the dam.

DESCRIPTION OF EMBODIMENTS

Embodiments of the present invention will be explained below. In the centrifugal separator equipped with a separated liquid jet nozzle in accordance with the present invention (first embodiment), as shown in FIG. 1 to FIG. 4, a plurality (four in the present embodiment) of liquid discharge ports 6 for discharging the separated liquid located inside a bowl 2 are disposed at equidistant and equiradial positions around the central axial line of the bowl 2 in a front hub 8 forming a liquid-discharge-side end section of the bowl 2.

Figure 1:
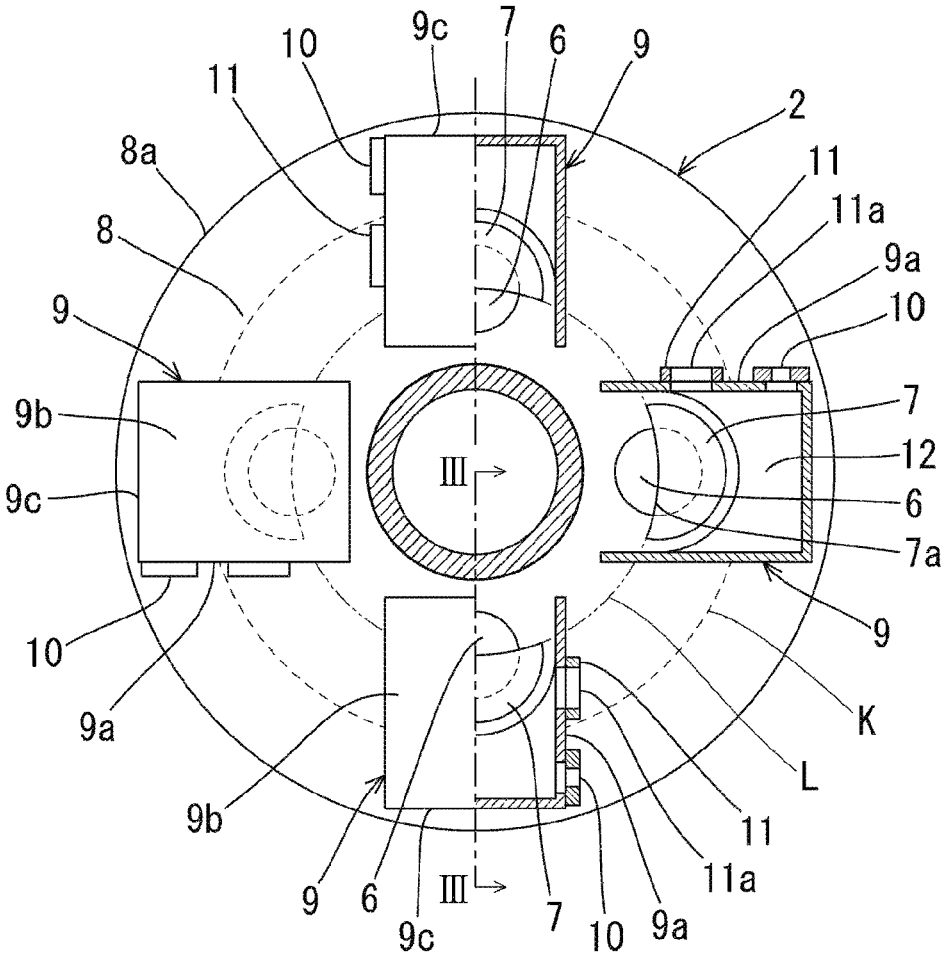
FIG. 1 is a front view of the end portion at the liquid discharge side of the bowl 2 constituting the centrifugal separator equipped with a separated liquid jet nozzle in accordance with the present invention (first embodiment).
Figure 3:
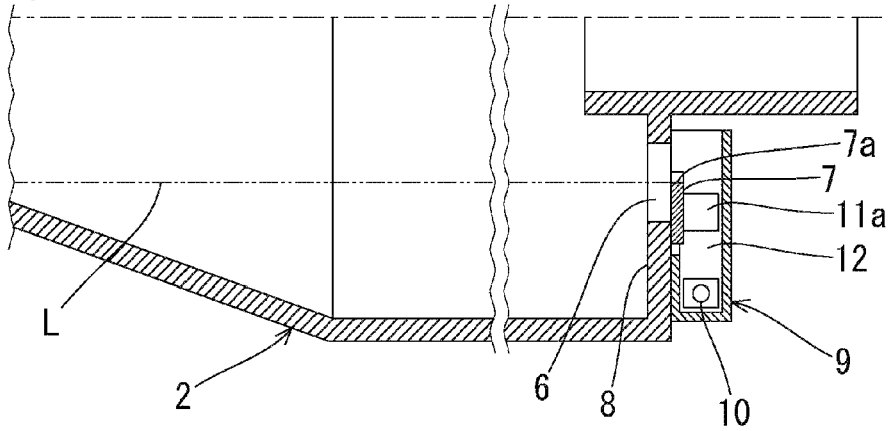
FIG. 3 is a cross-sectional view of the lower half portion of the bowl 2 taken along the III-III line shown in FIG. 1.
Figure 4:
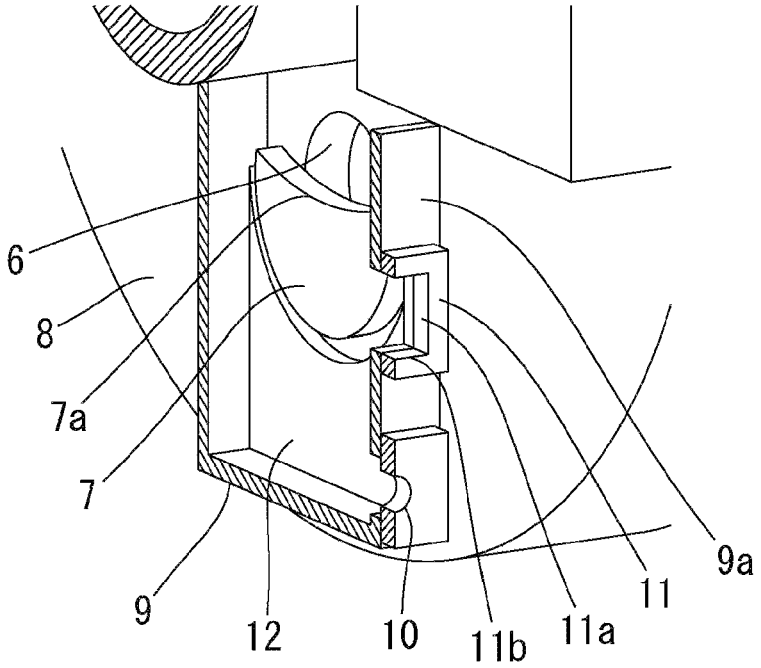
FIG. 4 is a sectional perspective view of the separated liquid jetting device 9 shown in FIG. 1 to FIG. 3.

A dam 7 determining the liquid level inside the bowl 2 is disposed in each of those liquid discharge ports 6, and the separated liquid located inside the bowl 2 is discharged by overflowing the top (on radially inward) of an overflow edge 7*a* of each dam 7. A double-dot-dash line L shown in FIG. 1 and FIG. 3 shows the liquid level position of the separated liquid inside the bowl 2 that is determined by the dams 7. Further, the dams 7 are configured to be attachable to, and detachable from the front hub 8, and the liquid level inside the bowl 2 can be set and changed, as appropriate, by preparing a plurality of dams 7 of different shapes and positions of the overflow edge 7*a* and attaching the suitable dam 7 according to the operation conditions such as the properties of the treatment object, treatment amount, and centrifugal force.

A separated liquid jetting device 9 with an external appearance such as shown in the left half of FIG. 1 and a cross-sectional shape such as shown in the right half of FIG. 1 is attached close to each liquid discharge port 6 in the front hub 8. Those separated liquid jetting devices 9 are disposed on radially outward of the liquid discharge ports 6, so as to collect the separated liquid that overflows the top of the overflow edges 7*a* of the dams 7 and is discharged from the bowl 2, and each separated liquid jetting device 9 has a separated liquid retention chamber 12 that temporarily retains the collected separated liquid inside thereof.

A jet nozzle 10 that communicates with the inside of the separated liquid retention chamber 12 via a through hole, opens in the direction opposite to the rotation direction of the bowl 2, and jets out the separated liquid located inside the separated liquid retention chamber 12 to the outside is attached to a side section 9*a* (on the rear side in the rotation direction of the bowl 2) of the separated liquid jetting device 9. In the centrifugal separator of the present embodiment, the bowl 2 is configured to rotate in the clockwise direction in FIG. 1. Therefore, the jet nozzle 10 is open in the counter-clockwise direction in FIG. 1. Further, in the present embodiment, the jet nozzle 10 is attached so as to communicate with the through hole formed in the side section 9*a* on the rear side in the rotation direction of the bowl 2, but the jet nozzle 10 may be also configured to be attached so as to communicate with a through hole formed in a side section 9*b* on the front side parallel to the front hub 8 or in a bottom section 9*c*, provided that the jet nozzle 10 is open in the direction opposite to the rotation direction of the bowl 2.

Figure 2:
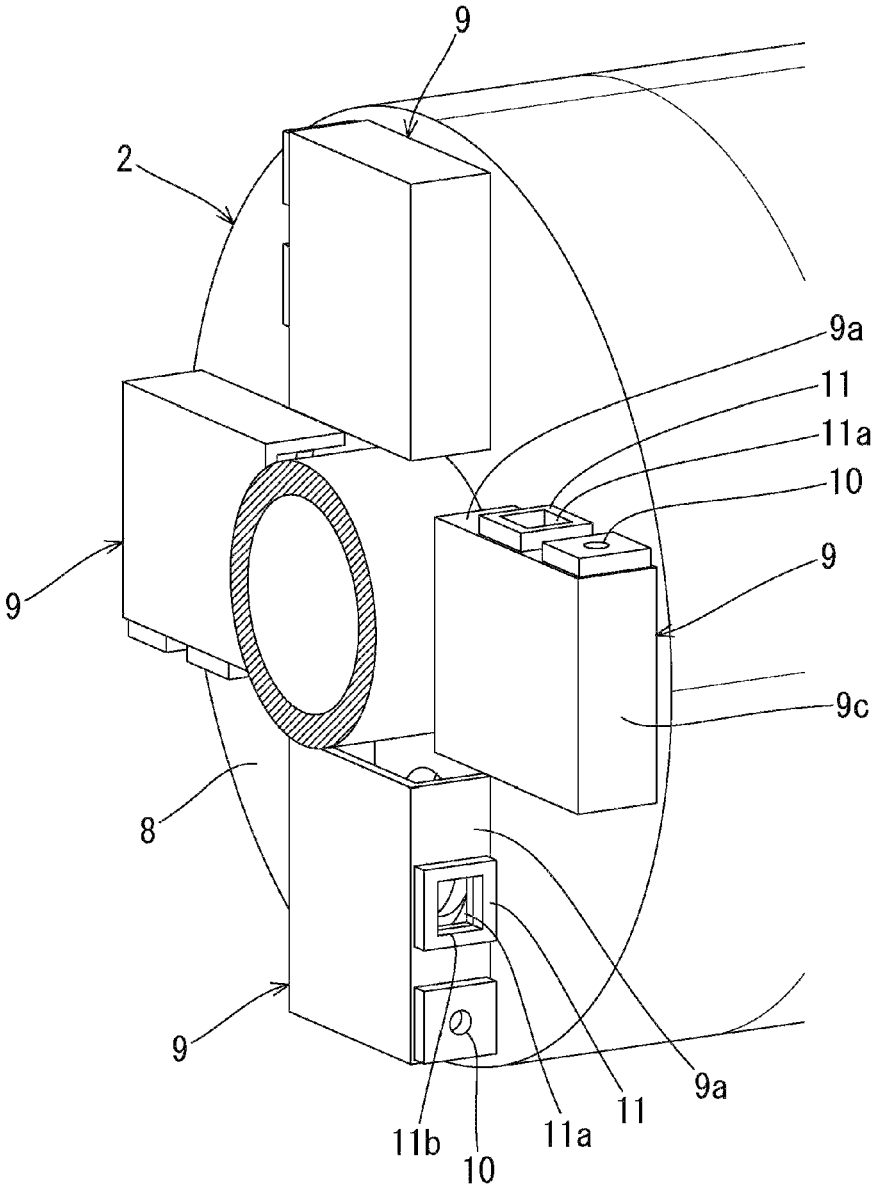
FIG. 2 is a perspective view of the end portion at the liquid discharge side of the bowl 2 constituting the centrifugal separator equipped with a separated liquid jet nozzle in accordance with the present invention (first embodiment).

Thus, as shown in FIG. 2, each separated liquid jetting device 9 includes a separated liquid tank (separated liquid retention chamber 12) that is container-shaped and that comprises side sections 9*a*, 9*b* and a bottom section 9*c* which are water-tightly connected to each other and to the front hub 8 (See FIG. 3). As shown in FIGS. 2 and 3, each separated liquid tank is positioned such that a front hub area radially outward of a corresponding liquid discharge port 6 is surrounded by the side sections 9*a*, 9*b* and the bottom section 9*c* of the separated liquid tank so as to define a space of the separated liquid tank where the separated liquid is pooled.

Where the solid-liquid separation treatment is executed by continuously introducing the raw liquid to be processed into the bowl 2 rotating at a high speed in the centrifugal separator of the present embodiment that has the above-described configuration, the separated liquid close to the liquid level inside the bowl 2 with a very low concentration of the solid content is continuously discharged from the liquid discharge ports 6 to the outside of the bowl 2 by overflowing the top of the overflow edge 7*a* of the dam 7, and the discharged separated liquid is collected by the separated liquid jetting devices 9, which are disposed on radially outward of the liquid discharge ports 6, and temporarily retained inside the separated liquid retention chamber 12.

The separated liquid retained inside the separated liquid retention chamber 12 is jetted out in the direction opposite to the rotation direction of the bowl 2 from the jet nozzle 10 open in the direction opposite to the rotation direction of the bowl 2 and discharged to the liquid recovery system. At this moment, the counterforce generated by jetting out the separated liquid from the jet nozzle 10 can be used as an auxiliary force for rotationally driving the bowl 2, thereby making it possible to reduce energy consumption on the rotational driving of the bowl 2.

As mentioned hereinabove, in the conventional centrifugal separator such as described in Patent Documents 1 and 2, since the through hole that causes the separated liquid to flow down from the bowl into the jet nozzle is formed on radially outward of the overflow edge of the dam, the separated liquid with a comparatively high concentration of the solid content, which is positioned on radially outward of the liquid level inside the bowl, flows out through the jet nozzle to the outside of the bowl and the solid contained in the raw liquid to be processed is discharged to the liquid recovery system. By contrast, in the present embodiment, the separated liquid with a very low concentration of the solid content, which overflows the top of the overflow edge 7*a* of the dam 7 and is discharged to the outside of the bowl 2, is collected outside the bowl 2 and then jetted out in the direction opposite to the rotation direction of the bowl 2, thereby producing a rotational auxiliary force for the bowl 2. Therefore the above-described problem can be advantageously avoided.

In the centrifugal separator of the present embodiment, since the jet nozzle 10 is disposed at a position close to an outer circumference 8*a* of the front hub 8, the problem of the separated liquid jetted out from the jet nozzle 10 colliding with the separated liquid jetting device 9 adjacent to the side in the direction opposite to the rotation direction of the bowl 2 and causing loss of the rotational energy in the bowl 2 can be advantageously avoided.

Further, the jet nozzle 10 is disposed at a position on radially outward of the position, shown by a broken line K in FIG. 1, distant from the overflow edge 7*a* by 50% of the distance from the overflow edge 7*a* to the outer circumference 8*a* of the front hub 8. As a result, a centrifugal force, which is larger than that acting upon the separated liquid that has just overflowed the overflow edge 7*a* of the dam 7, acts upon the separated liquid that has been discharged from the bowl 2 and temporarily retained inside the separated liquid retention chamber 12. Such a large centrifugal force makes it possible to increase the flow velocity of the separated liquid jetted out from the jet nozzle 10. As a result, a larger counterforce (auxiliary force for rotationally driving the bowl 2) can be obtained and energy consumption on the rotational drive of the bowl 2 can be effectively reduced.

In the present embodiment, the jet nozzle 10 is configured to be attachable to, and detachable from the main body of the separated liquid jetting device 9. Therefore, the separated liquid can be quantitatively and stably jetted out from the jet nozzle 10, while maintaining a constant liquid level of the separated liquid that is retained inside the separated liquid retention chamber 12, by preparing a plurality of jet nozzles 10 of different opening diameters and attaching the jet nozzle 10 with an adequate opening diameter according to the operation conditions such as the treatment amount, discharge amount of the separated liquid, and centrifugal force.

Further, in the present embodiment, a release port 11*a* for the separated liquid is formed above (on radially inward) of the jet nozzle 10 in the separated liquid jetting device 9, and this release port 11*a* is configured such that a lower edge 11*b* is positioned on radially outward of the overflow edge 7*a* of the dam 7. Therefore, even when the discharge amount of the separated liquid from the bowl 2 rises above the amount jetted out from the jet nozzle 10 and the liquid level of the separated liquid retained inside the separated liquid retention chamber 12 rises due to changes in the treatment amount or the like, the excess is released from the release port 11*a* to the outside of the device, thereby making it possible to restrict the liquid level of the separated liquid inside the separated liquid retention chamber 12 to a position of the lower edge 11*b* of the release port 11*a*, that is, a position on radially outward of the overflow edge 7*a* of the dam 7.

Where the liquid level of the separated liquid inside the separated liquid retention chamber 12 rises to the position of the overflow edge 7*a* of the dam 7, the dam 7 loses the function of determining the liquid level inside the bowl 2, but in the present embodiment, because the release port 11*a* that has the above-described configuration is formed, such a problem can be advantageously avoided.

The size of the release port 11*a* and the position of the lower edge 11*b* can be changed, as appropriate, according to the conditions relating to the dam 7, which is attached to the front hub 8, by replacing the frame plate 11 with the frame plate of different size or position of the opening.

Further, in the present embodiment, the jet nozzle 10 and the frame plate 11 having the release port 11*a* are attached to the side section 9*a* on the rear side in the rotation direction of the bowl 2, from among the side sections of the separated liquid jetting device 9, and the release port 11*a* is configured such as to be open in the direction opposite to the rotation direction of the bowl 2, similarly to the jet nozzle 10, but the release port 11*a* should not necessarily be open in such a direction. For example, a configuration may be used in which a through hole is formed in, and the frame plate 11 is attached to the side section 9*b* of the front side that is parallel to the front hub 8, and the release port 11*a* is open in same direction as that of the rotation axial line of the bowl 2, as in the centrifugal separator (second embodiment of the present invention) shown in FIG. 5.

In this case, the configuration is preferred such that the release port 11*a* is open at a position shifted from the liquid discharge port 6 to the front side in the rotation direction of the bowl 2 so that the separated liquid that overflows the top (on radially inward) of the overflow edge 7*a* of the dam 7 and is discharged from the bowl 2 could be prevented from being directly discharged from the release port 11*a* to the outside of the separated liquid jetting device 9 without being retained inside the separated liquid retention chamber 12.

Figure 5:
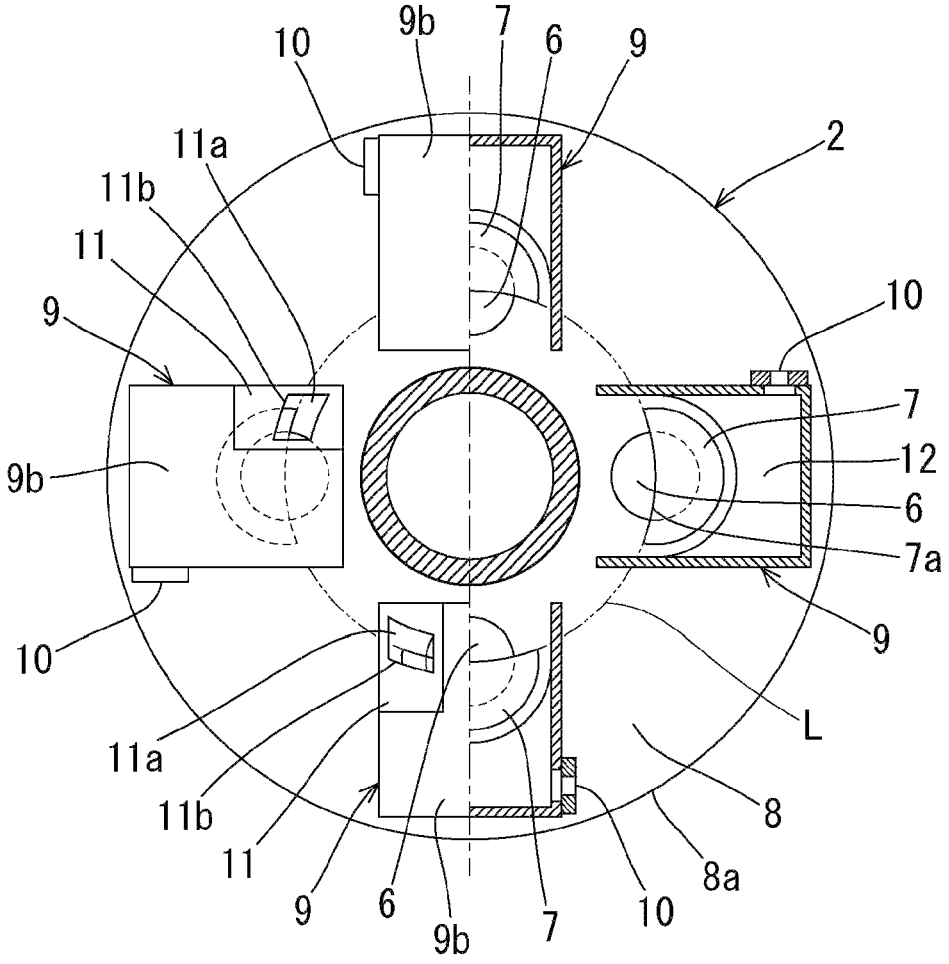
FIG. 5 is a front view of the end portion at the liquid discharge side of the bowl 2 constituting the centrifugal separator equipped with a separated liquid jet nozzle in accordance with the present invention (second embodiment).
Figure 6:
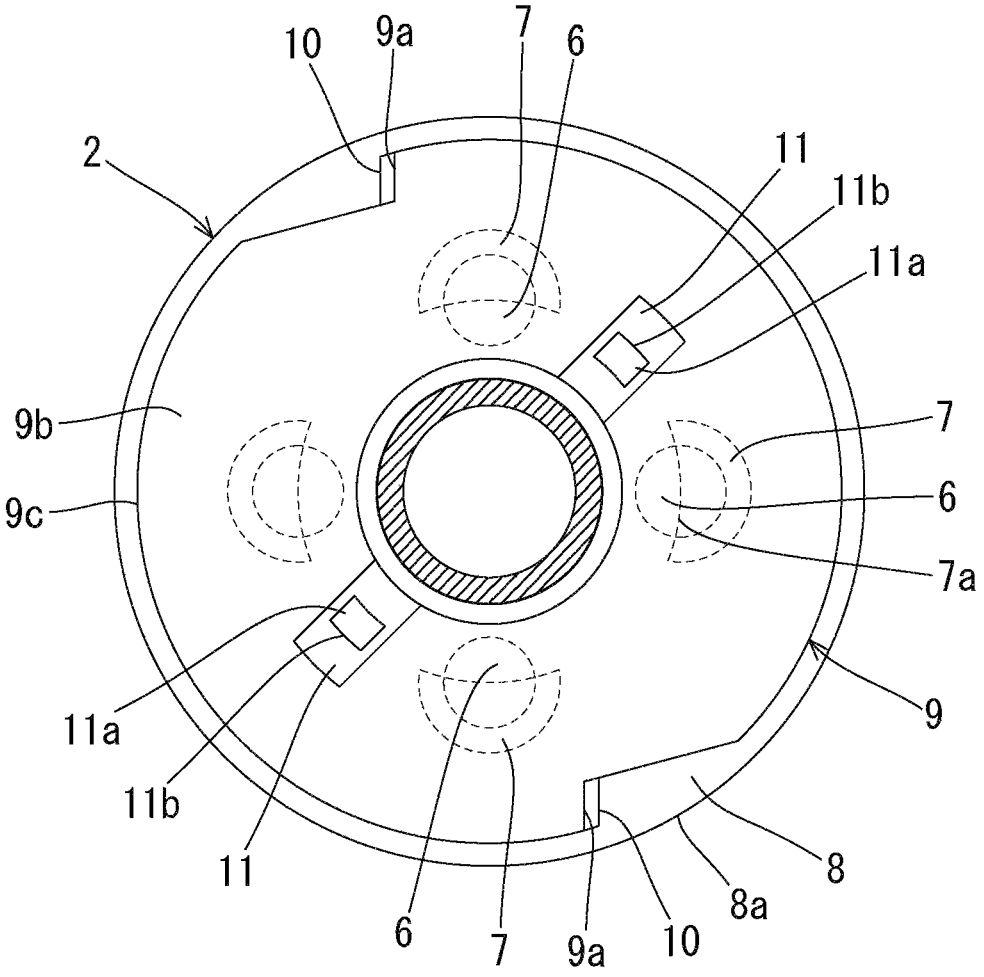
FIG. 6 is a front view of the end portion at the liquid discharge side of the bowl 2 constituting the centrifugal separator equipped with a separated liquid jet nozzle in accordance with the present invention (third embodiment).
Figure 7:
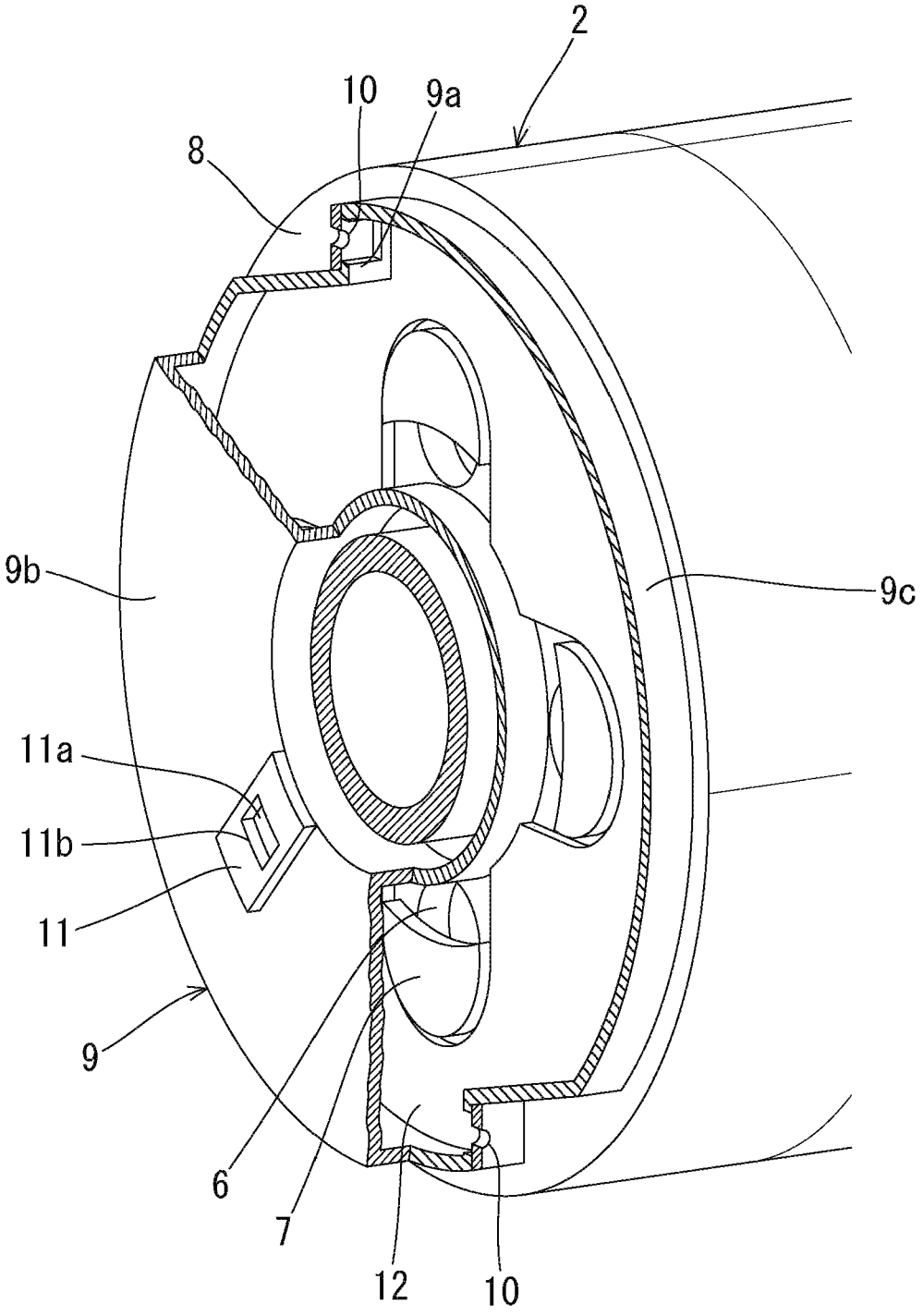
FIG. 7 is a cut-out perspective view of the end portion at the liquid discharge side of the bowl 2 constituting the centrifugal separator equipped with a separated liquid jet nozzle in accordance with the present invention (third embodiment).
Figure 8:
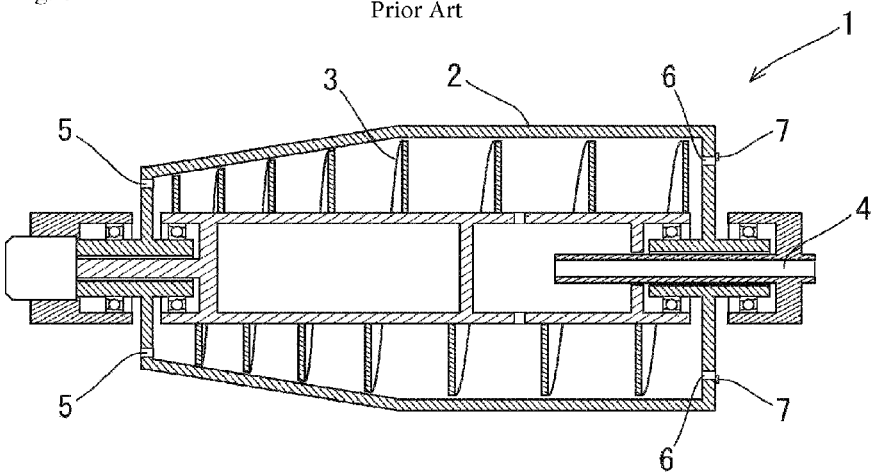
Fig. 8 Prior Art
FIG. 8 shows a typical structure of the decanter-type centrifugal separator 1.
Figure 9:
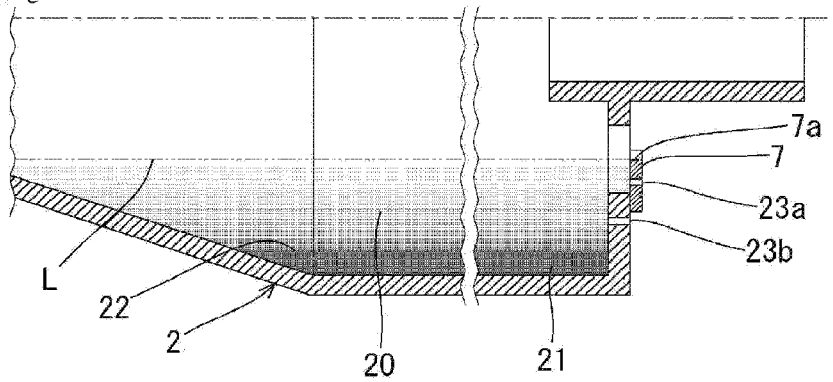
Prior Art Fig. 9
FIG. 9 shows an example of the structure of the bowl 2 in the conventional decanter-type centrifugal separator.

In the centrifugal separator according to the first embodiment, which is shown in FIG. 1 to FIG. 4, and the centrifugal separator according to the second embodiment, which is shown in FIG. 5, one separated liquid jetting device 9 is attached for each liquid discharge port 6, but the liquid discharge port 6 and the separated liquid jetting device 9 should not necessarily satisfy the one-to-one relationship. Thus, a configuration may be also used in which all of (or a plurality of) the liquid discharge ports 6 are covered by a single separated liquid jetting device 9 having a single separated liquid retention chamber 12, as in the centrifugal separator (third embodiment of the present invention) shown in FIG. 6 and FIG. 7. In this case, as shown in FIG. 6 and FIG. 7, the air resistance during the rotation can be decreased and energy consumption can be further reduced by configuring the separated liquid jetting device 9 in a ring-like shape.

In the centrifugal separators of the above-described embodiments of the present invention, the separated liquid jetting device 9 attached to the front hub 8 of the bowl 2 can be readily attached to already installed centrifugal separators. Therefore, the separated liquid jetting device 9 can be used as an energy saving measure for already installed centrifugal separators.

REFERENCE SIGNS LIST

1 centrifugal separator
2 bowl
3 screw conveyor
4 feed tube
5 solid discharge port
6 liquid discharge port
7 dam
7*a* overflow edge
8 front hub
8*a* outer circumference
9 separated liquid jetting device
9*a*, 9*b* side section
9*c* bottom section
10 jet nozzle
11 frame plate
11*a* release port

11*b* lower edge
12 separated liquid retention chamber
20 separated liquid
21 solid phase
22 interface
23*a*, 23*b* through hole

The invention claimed is:

1. A centrifugal separator comprising:

a hollow bowl, and a screw conveyor which is disposed coaxially with the hollow bowl inside the hollow bowl, wherein the centrifugal separator is adapted to process a raw liquid introduced in the hollow bowl such that the raw liquid is separated by a centrifugal force into a liquid and a solid content as a result of rotation of the hollow bowl and the screw conveyor, wherein the separated solid content is transported by the screw conveyor rotating with a difference in speed with respect to the hollow bowl to a solid discharge port formed at one end of the hollow bowl, and the solid content is discharged to an outside of the hollow bowl, and wherein the separated liquid is discharged to the outside of the bowl from a plurality of liquid discharge ports formed in a front hub constituting an opposite end of the hollow bowl, wherein a dam determining a liquid level inside the bowl is disposed in each of the plurality of liquid discharge ports;

wherein the centrifugal separator further comprises a separated liquid jetting device which collects the separated liquid that has overflowed a top of an overflow edge of a corresponding dam and that has been discharged from the hollow bowl, wherein the separated liquid jetting device is attached to the front hub at a position radially outward of each of the plurality of liquid discharge ports; and wherein each separated liquid jetting device includes a separated liquid tank that is container-shaped, that comprises side sections and a bottom section which are water-tightly connected to each other and to the front hub, and that is positioned such that a front hub area radially outward of a corresponding liquid discharge port is surrounded by the side sections and the bottom section of the separated liquid tank so as to define a space of the separated liquid tank where the separated liquid is pooled, and wherein each separated liquid jetting device further includes a separated liquid jet nozzle that is open in a direction opposite to a rotation direction of the hollow bowl, that jets out the separated liquid located inside the separated liquid tank to the outside, and that is disposed at any of the side sections or the bottom section of the separated liquid tank.

2. The centrifugal separator according to claim 1, wherein a release port that releases an excess of the separated liquid retained in the separated liquid tank is formed in each separated liquid jetting device, at a position radially inward of the separated liquid jet nozzle.

3. The centrifugal separator according to claim 1, wherein a release port that releases an excess of the separated liquid retained in the separated liquid tank is formed in each separated liquid jetting device at a position radially inward of the separated liquid jet nozzle, and wherein the release port is configured such that a lower edge thereof is positioned radially outward of the overflow edge of the dam.

4. The centrifugal separator according to claim 1, wherein the separated liquid jet nozzle is disposed at a position radially outward of a position distant from the overflow edge of the dam by 50% of a distance from the overflow edge of the dam to an outer circumference of the front hub.

* * * * *